US005723863A

United States Patent [19]

Bergen

[11] Patent Number: 5,723,863

[45] Date of Patent: Mar. 3, 1998

[54] ION CHARGING APPARATUS WITH LIGHT BLOCKING CAPABILITY

[75] Inventor: Richard F. Bergen, Ontario, N.Y.

[73] Assignee: Xerox Corporation, Stamford, Conn.

[21] Appl. No.: 623,291

[22] Filed: Mar. 28, 1996

[51] Int. Cl.[6] ..... H01T 19/04

[52] U.S. Cl. ..... 250/326; 250/324

[58] Field of Search ..... 250/324, 325, 250/326

[56] References Cited

U.S. PATENT DOCUMENTS

| | | | |
|---|---|---|---|
| 2,588,699 | 3/1952 | Carlson | 95/1.9 |
| 2,777,957 | 1/1957 | Walkup | 250/19.5 |
| 3,598,991 | 8/1971 | Nost | 250/49.5 |
| 4,086,650 | 4/1978 | Davis et al. | 361/229 |
| 4,100,411 | 7/1978 | Davis | 250/324 |
| 4,155,093 | 5/1979 | Fotland et al. | 346/159 |
| 4,174,170 | 11/1979 | Yamamoto et al. | 355/3 TR |
| 4,426,654 | 1/1984 | Tarumi et al. | 250/326 |
| 4,463,363 | 7/1984 | Gundlach et al. | 346/159 |
| 4,524,371 | 6/1985 | Sheridon et al. | 346/159 |
| 4,700,261 | 10/1987 | Nagase et al. | 250/326 |
| 4,783,716 | 11/1988 | Nagase et al. | 250/326 |
| 4,785,372 | 11/1988 | Hosono et al. | 250/325 |
| 4,841,146 | 6/1989 | Gundlach et al. | 250/324 |
| 4,963,738 | 10/1990 | Gundlach et al. | 250/326 |
| 5,411,825 | 5/1995 | Tam | 430/41 |

*Primary Examiner*—Bruce Anderson
*Attorney, Agent, or Firm*—William A. Henry, II

[57] ABSTRACT

A corona generating device with light blocking ability in order to prevent premature exposure of film includes a dielectric support substrate, a corona producing member attached to a surface of the dielectric support member, a low voltage DC source connected to the corona producing member, a blocking electrode positioned above a surface of the dielectric support substrate opposite from the surface having the corona producing member attached thereto with the blocking electrode being adapted to block light produced by ions emitted from said corona producing member from reaching the area of the film being charged, and a high voltage AC source coupled to the corona producing member for energizing the corona producing member to emit ions therefrom.

13 Claims, 1 Drawing Sheet

ION CHARGING APPARATUS WITH LIGHT BLOCKING CAPABILITY

BACKGROUND OF THE INVENTION

Figure 1:
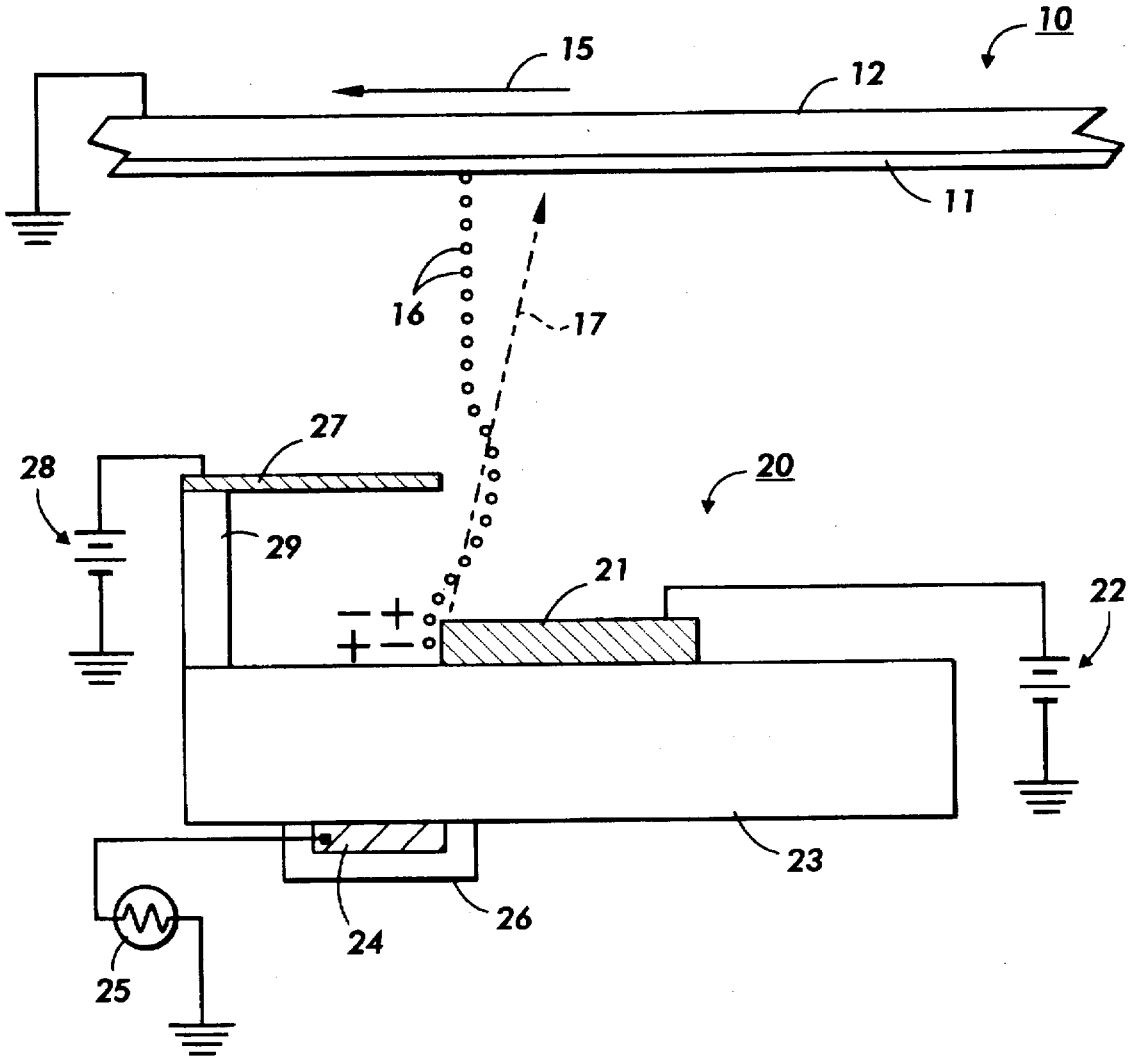

This Application hereby cross-references U.S. patent application Ser. No. 08/623,498, filed Mar. 28, 1996, entitled "LIGHT BLOCKING ION CHARGING APPARATUS", assigned to the assignee hereof now U.S. Pat. No. 5,655,186.

1. Field of the invention.

This invention relates to a novel ion charging apparatus wherein ions are generated and passed around a barrier to block out light in order to uniformly charge a charge receptor.

Corona charging of xerographic photoreceptors has been disclosed as early as U.S. Pat. No. 2,588,699. It has always been a problem that current levels for practical charging require coronode potentials of many thousands of volts, while photoreceptors typically cannot support more than 1000 volts surface potential without dielectric breakdown.

One attempt at controlling the uniformity and magnitude of corona charging is U.S. Pat. No. 2,777,957 which makes use of an open screen as a control electrode, to establish a reference potential, so that when the receiver surface reaches the screen voltage, the fields no longer drive ions to the receiver, but rather to the screen. Unfortunately, a low porosity screen intercepts most of the ions, allowing a very small percentage to reach the intended receiver. A more open screen, on the other hand, delivers charge to the receiver more efficiently, but compromises the control function of the device.

Other methods exist for trying to obtain uniform charging from negative charging systems such as dicorotron charging devices as shown in U.S. Pat. No. 4,086,650 that includes glass coated wires and large specialized AC power supplies.

Various ion generating devices are available for printing or charging purposes. For example, in U.S. Pat. No. 4,463,363 there is taught D.C. air breakdown form of ion generator. In U.S. Pat. No. 4,524,371 a fluid jet assisted ion projection printing apparatus is disclosed that includes a housing having ion generation and ion modulation regions. A bent path channel, disposed through the housing, directs transport fluids with ions entrained therein adjacent an array of modulation electrodes which control the passage of ion beams from the device. Emission of charged particles in U.S. Pat. No. 4,155,093 is accomplished by extracting them from a high density source provided by an electrical gas breakdown in an alternating electrical field between two conducting electrodes separated by an insulator. A corona discharge unit is used in conductive toner transfer in a copier in U.S. Pat. No. 4,174,170. The corona discharge unit includes a slit to permit transfer of conductive toner particles onto a copy paper charged by the corona unit. A corona wire in the unit is surrounded by a shield. U.S. Pat. No. 3,396,308 discloses a web treating device for generating a flow of ionized gas. This device includes an opening through which the gas is directed towards a receptor surface. An elongated hollow hosing 11 has tapered sides 14 terminating in a pair of lips 15 which form a narrow and elongated slot 16. U.S. Pat. Nos. 3,598,991 and 4,100,411 show electrostatic charging devices including a corona wire surrounded by a conductive shield. In U.S. Pat. No. 3,598,991, a slit 13 is formed in the shield to allow ions to flow from wire 12 to a photoconductive surface 2 to deposit an electric charge thereon. In U.S. Pat. No. 4,100,411, a pair of lips 16 and 17 define a corona ion slit 18. Japanese Patent Document No. 55-73070 discloses a powder image transfer type electrostatic copier that includes a corona discharge device having a slit in a shield plate. In Japanese Patent Document No. 54-156546 a corona charge is shown having a plurality of grating electrodes in the opening part of a corona shield electrode. These devices have not been entirely satisfactory in that they are costly, some of them are hard to fabricate and are inefficient.

In addition, the problem of uniformity of charge is more pronounced when migration imaging is attempted using Verde film that is disclosed in U.S. Pat. No. 5,411,825. In contrast to typical copier/printer speeds which are nearer to 4 inches per second, the process speed for Verde film is very slow and at times less than 4 inches per minute. Consequently, Verde film requires approximately 3.5 times less light for exposure than some photoreceptors. With Verde film traveling at 4 inches per minute, fogging as a result of exposure from corona generated light striking the photoreceptor prior to charge is a major problem.

Accordingly, a charging apparatus is provided for use in any of the various printing and imaging processes. The light blocking ion charging apparatus of the present invention overcomes the above-described problems and disadvantages of conventional charging devices.

Specifically, this invention provides a charging device with a portion thereof between a corona source and a charge receptor that blocks corona generated light without unduly affecting the performance of the charging device.

Other features of the present invention will become apparent as the following description proceeds and upon reference to the drawings in which:

FIG. 1 is an enlarged elevational view of a charging unit that incorporates light blocking electrodes in the unit in accordance with an aspect of the present invention.

While the invention will be described herein in connection with preferred embodiments, it will be understood that no intention is made to limit the invention to the described embodiment. On the contrary, it is intended to cover all alternatives, modifications, and equivalents as may be included within the spirit and scope of the invention as defined by the appended claims.

For a general understanding of the features of the invention, reference is made to the drawings. In the drawing, like reference numerals have been used throughout to designate identical elements.

In accordance with an aspect of the present invention, FIG. 1 depicts a novel charging unit that satisfies the aims and objectives of this invention that comprises an ion source which includes DC low voltage source 22 connected to corona producing electrode 21 that is supported on the top surface of an insulating/dielectric support member 23. An AC, high voltage/high frequency source 25, e.g., 4 kVp-p, is electrically connected to lower electrode 24 which is attached to the bottom surface of insulating/dielectric support member 23. Both electrodes 21 and 24 comprise suitable conductive materials, such as, copper or palladium silver in a ceramic or glass binder, all of which are supported on the top and bottom surfaces of insulating/dielectric support 23, preferably containing between 50% and 100% of alumina ($Al_2O_3$). Lower electrode 24 has a conductive solid area with a length and width preferably the same as electrode 21. It is desirable to apply an insulating overcoat 26 on lower electrode 24 for preventing corona formation at that electrode. An insulating support member 29 extends orghogonally from the top surface of insulating/dielectric support member 23 and supports an upper electrode 27 that is DC biased at 28 in spaced relation with respect to electrode 21.

As shown in FIG. 1, a grounded imaging member 10 is moved in the direction of arrow 15 above charging apparatus 20 and includes a charge retentive member 11 mounted on a support member 12. With charge retentive member 11 being a sensitive film, such as, Verde film marketed by Xerox Corporation and disclosed in U.S. Pat. No. 5,411,825, light sensitivity requires approximately 3.5 times less sight for exposure than some charge retentive members. With Verde film traveling at 4 inches per minute beneath the corona, fogging as a result of exposure from corona generated light must be prevented. As a fogging prevention measure, upper electrode 27 of charge apparatus 20 is provided and extends in parallel with electrode 21 until the right edge thereof as viewed in FIG. 1 is in line vertically with the left edge of electrode 21. As a result, light 17 is striking charge retentive member 11 prior to charge in the form of ions 16.

In operation of the charging apparatus of the present invention, the AC powered lower electrode 24 on one side of insulating member 23 provides fields that generate corona along the left edge of electrode 21. DC potential applied to corona producing electrode 21 and upper electrode 27, provides the fields to drive and level charges to the charge retentive surface 11 of imaging member 10. Corona 16 is produced on the left edge of electrode 21.

While this invention has been described with reference to the structure disclosed herein, it is not intended to be confined to the details set forth and are intended to cover modifications and changes that may come within the spirit and scope of the claims.

What is claimed is:

1. A corona generating device, comprising:

a dielectric support substrate;

a corona producing member attached to one side of said dielectric support member;

a low voltage DC source connected to said corona producing member;

a blocking electrode positioned above said dielectric support substrate and adapted to block light produced by ions emitted from said corona producing member;

an electrode connected to the opposite side of said dielectric support substrate; and a high voltage AC source coupled to said electrode to provide fields that generate corona along an edge of said corona producing member.

2. The corona generating device of claim 1, wherein said blocking electrode is DC biased.

3. The corona generating device of claim 2, wherein said blocking electrode is spaced above and parallel with said corona producing member.

4. The corona generating device of claim 3, wherein said blocking electrode and corona producing member have edges and said blocking electrode has an edge thereof in line vertically with an edge of said corona producing member.

5. The corona generating device of claim 4, wherein said dielectric support substrate is made of alumina.

6. A system for charging a charge retentive surface while preventing fogging of the charge retentive surface due to exposure from corona generated light, comprising:

a charge retentive surface;

a dielectric support substrate;

a corona producing member attached to a first surface of said dielectric support member;

a low voltage DC source connected to said corona producing member, a blocking electrode adapted to deflect light produced by ions emitted from said corona producing member;

an electrode connected to a second surface of said dielectric support substrate; and a high voltage AC source coupled to said electrode to provide fields that generate corona along an edge of said corona producing member.

7. The system of claim 6, wherein said blocking electrode is DC biased.

8. The system of claim 7, wherein said blocking electrode is spaced above and parallel with said corona producing member.

9. The system of claim 8, wherein said blocking electrode and corona producing member have edges and said blocking electrode has an edge thereof in line vertically with an edge of said corona producing member.

10. A corotron apparatus comprising:

a dielectric support substrate having top and bottom surfaces;

a corona producing member positioned on top of said top surface of said dielectric support substrate;

a low voltage DC source connected to said corona producing member;

an electrode attached to said bottom surface of said dielectric support member;

a high voltage AC source coupled to said corona producing member through said electrode for energizing said corona producing member to emit ions therefrom; and a blocking electrode adapted to block light produced by ions emitted from said corona producing member from reaching charged regions of a charge receptor.

11. The corotron apparatus of claim 10, wherein said blocking electrode is DC biased.

12. The corotron apparatus of claim 11, wherein said blocking electrode is spaced above and parallel with said corona producing member.

13. The corona apparatus of claim 12, wherein said blocking electrode and corona producing member have edges and said blocking electrode has an edge thereof in line vertically with an edge of said corona producing member.

* * * * *